United States Patent [19]

Kaneko

[11] Patent Number: 4,480,826

[45] Date of Patent: Nov. 6, 1984

[54] PAPER FEEDER

[75] Inventor: Midori Kaneko, Sakai, Japan

[73] Assignee: Hamada Printing Press Mfg. Co., Ltd., Osaka, Japan

[21] Appl. No.: 396,481

[22] Filed: Jul. 8, 1982

[30] Foreign Application Priority Data

Mar. 11, 1982 [JP] Japan ..... 57-39889
Mar. 11, 1982 [JP] Japan ..... 57-35442[U]

[51] Int. Cl.[3] ..... B65H 3/08

[52] U.S. Cl. ..... 271/103; 271/31; 271/104; 271/152

[58] Field of Search ..... 271/103, 104, 30 R, 271/31, 152, 156

[56] References Cited

U.S. PATENT DOCUMENTS 2,224,802 12/1940 Spiess ..... 271/103 X
2,341,521 2/1944 Baker ..... 271/103
3,921,971 11/1975 Vollrath ..... 271/103

*Primary Examiner*—Richard A. Schacher
*Attorney, Agent, or Firm*—Wenderoth, Lind & Ponack

[57] ABSTRACT

An improved paper feeder for use with a printing machine includes a suction head which moves up and down by suction force and moves forward and backward by action of a cam. The paper feeder further includes an arrangement for controlling the height of the paper table.

2 Claims, 10 Drawing Figures

PAPER FEEDER

BACKGROUND OF THE INVENTION

1. Field of the Invention

The present invention relates to a paper feeder for feeding sheets of paper continuously one after another from a stack of papers on a paper table in a printing machine. 2. Description of the Prior Art Among known paper feeders, there are two types, one is the friction type such as the koenig type and the rotary type, and the other is the suction type among which there are the universal feeder, the Dexter feeder, and the stream feeder. With the stream feeders sheets of paper are fed shingled while with the universal and Dexter feeders they are fed sheet by sheet.

The universal feeder has two types. One is shown in FIG. 1 in which a suction pad 23 is lowered on to a stack of papers P and, after sucking a paper P, goes up and forward in a loop. The other is shown in FIG. 2 in which the suction pad 23 already in a down position sucks a sheet of paper P and goes up forward in a loop. However, both of the types are slow in action, resulting in a low paper feed speed. Further, the driving mechanism for the suction pad is complicated and time-consuming for assembly.

SUMMARY OF THE INVENTION

An object of the present invention is to provide a paper feeder which can feed sheets of paper at a high speed and is more simple in construction.

In accordance with the present invention, as shown in FIG. 3, a suction pad 23 elevatably supported by a suction head 14 is lowered on to a stack of papers P by means of suction force supplied to suck up the paper P, goes up by the bias of a spring and is pushed forward by a cam to feed the paper P forward and urged back by a spring. Papers P can be fed from a stack of papers P at a high speed by vertical and horizontal movements of the suction pad 23. Because of simple construction, the paper feeder according to this invention is less liable to cause trouble and is easy to assemble.

Other features and advantages of the present invention will become apparent from the following description taken with reference to the accompanying drawings.

DETAILED DESCRIPTION OF THE INVENTION

Figure 1:
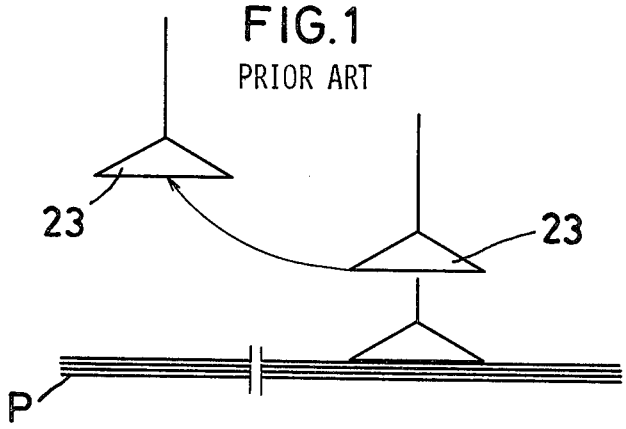
FIG.1 PRIOR ART
FIG. 1 is a schematic view showing the movement of a suction head on a conventional paper feeder.
Figure 2:
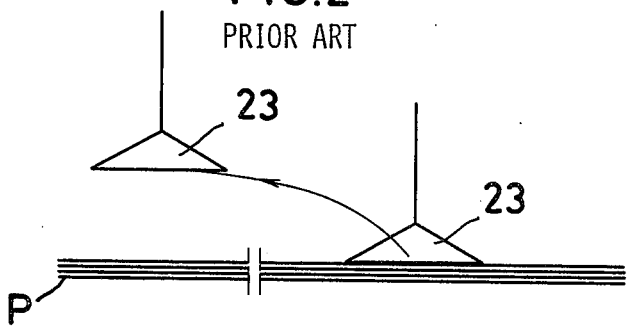
FIG.2 PRIOR ART
FIG. 2 is a similar view of another conventional paper feeder.
Figure 3:
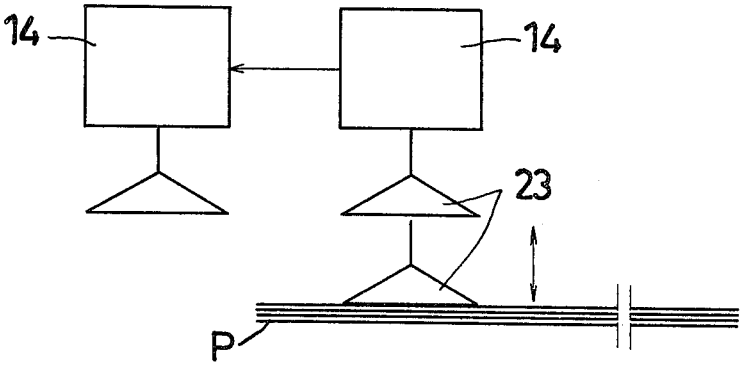
FIG. 3 is a similar view of a paper feeder embodying the present invention.
Figure 4:
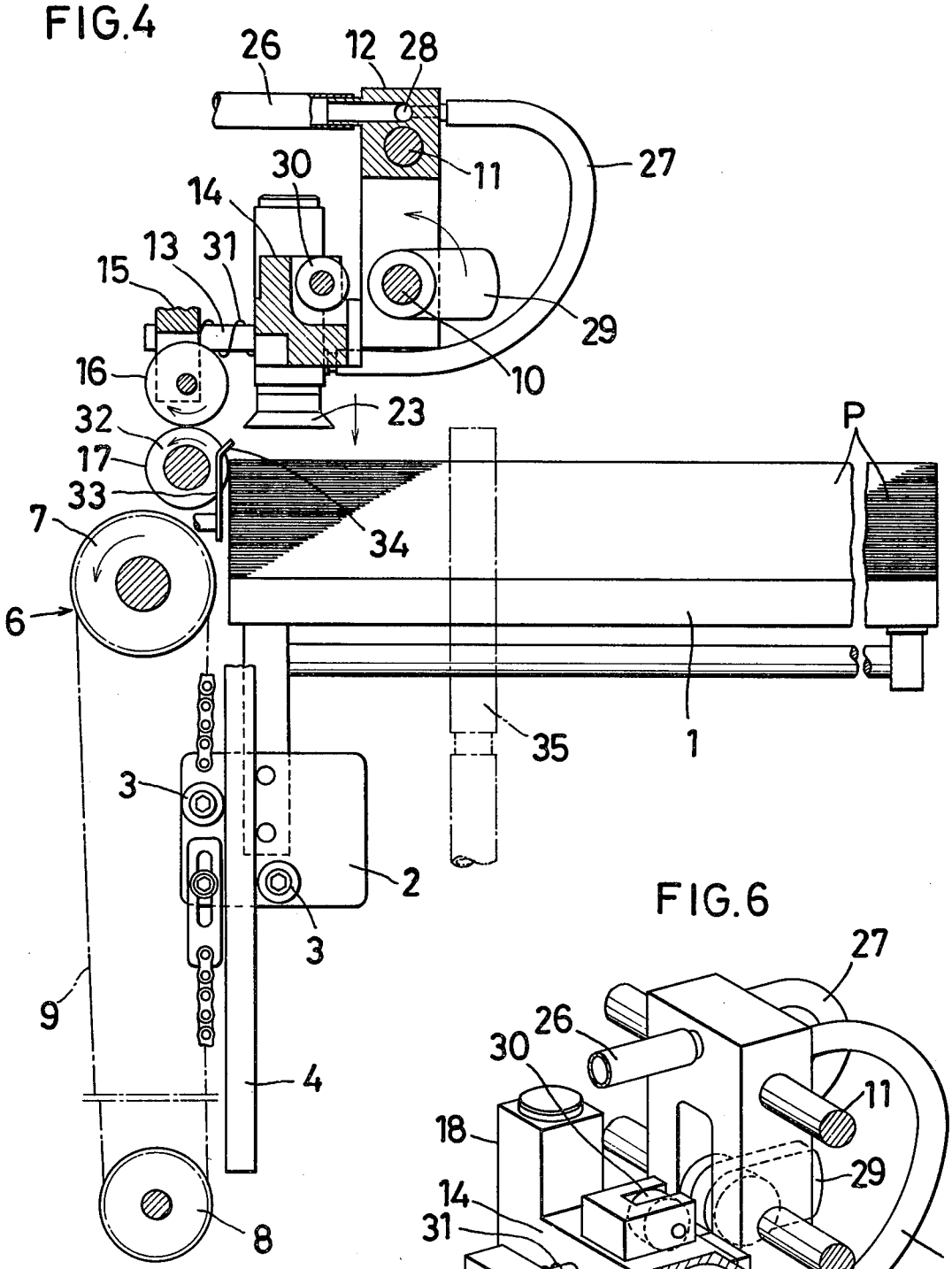
FIG. 4 is a vertical sectional view of the embodiment.
Figure 5:
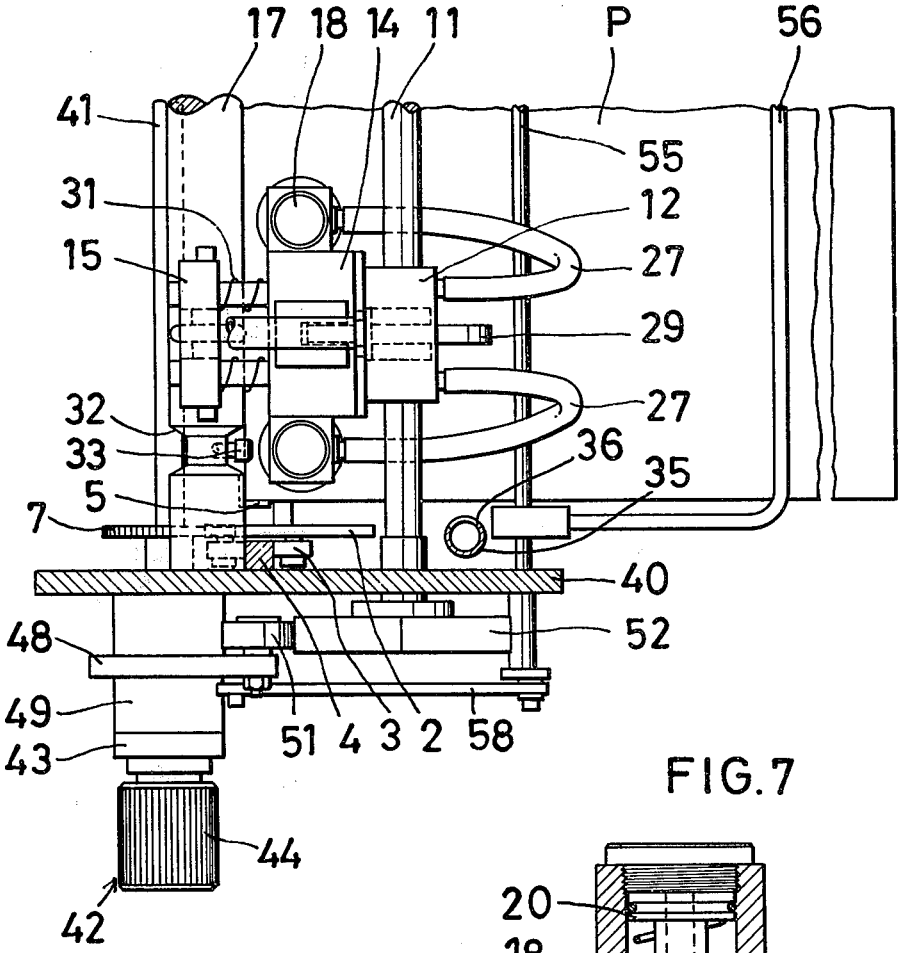
FIG. 5 is a plan view of the same.

Referring to FIGS. 4 to 7, a paper table 1 for supporting a stack of paper P is supported by a bracket 2. A plurality of rollers 3 are mounted on the bracket to be disposed on each side of a fixed guide rail 4 so as to be guided thereby. Inside of the guide rail 4, there is provided an L-shape paper guide 5 (FIG. 5 only). The paper table 1 is elevatable along the paper guide 5 and the guide rail 4. When several sheets of papers P are fed from the paper table 1 so that the top level of the paper stack will lower, a table drive unit 6 will operate to raise the table 1, thereby maintaining the top of the paper stack at the same height.

As shown in FIG. 4, the table drive unit 6 has a pair of sprockets 7 and 8 provided in front of the paper table 1, and a chain 9 passing around the sprockets 7 and 8 and having two ends connected to the bracket 2. When some sheets of paper P are fed from the paper table 1, the upper sprocket 7 will be rotated in the direction of an arrow indicated in FIG. 4 so that the paper table 1 will go up to the original height. How the table 1 is raised will be described below.

Over the paper table 1, there are provided a driving shaft 10 and a guide shaft 11 parallel to each other. These shafts 10 and 11 extend through a support block 12. Two guide bars 13 extend forwardly from the bottom front of the support block 12. A suction head 14 is supported to be movable along the guide bars 13. A roller support 15 is mounted on the ends of the guide bars 13 to support rotatably an upper feed roller 16.

A lower feed roller 17 provided under the upper feed roller 16 is driven by a suitable drive unit to rotate in the direction of an arrow indicated in FIG. 4. The lower feed roller 17 cooperates with the upper feed roller 16 to feed the paper blanks P to the left on FIG. 4.

Figure 6:
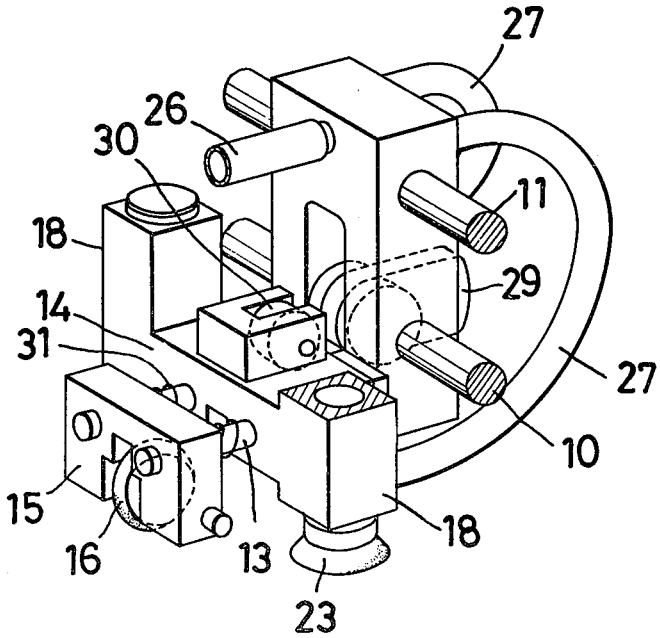
FIG. 6 is a partially cutaway perspective view of a portion of the same.

As shown in FIG. 6, a cylinder 18 is provided on each side of the suction head 14 and has a suction port 19 at its bottom. See FIG. 7. Each cylinder 18 has a piston 20 adapted to slide up and down therein and a spring 21 urging the piston 20. A rod 22 extends from the bottom of the piston 20 beyond the lower end of the cylinder 18 and has a suction pad 23 mounted at its end.

The piston 20 and the rod 22 are formed with a suction path 24 extending therethrough. The suction path 24 communicates with the inside of the cylinder 18 through a hole 25 in the wall of the rod 22.

As shown in FIG. 4, a suction hose 26 and two hoses 27 (see FIGS. 5 and 6 also) are connected to the upper part of the support block 12 and communicate with each other through a path 28 formed in the support block 12. The other ends of the hoses 27 are connected to suction ports 19 of the cylinders 18 provided in the suction head 14.

The driving shaft 10 supporting the support block 12 is driven by a suitable driving unit to rotate in the direction of an arrow indicated in FIG. 4. As the shaft 10 turns, a cam 29 mounted thereon engages a cam follower 30 mounted on the suction head 14, moving the suction head 14 forwardly. It is urged backwardly by coil springs 31 mounted on the guide bars 13.

In operation as shown in FIG. 4, the paper blanks P on the paper table 1 are fed one after another by suction force supplied from the suction hose 26. The driving shaft 10 is kept turning in the direction of the arrow.

Figure 7:
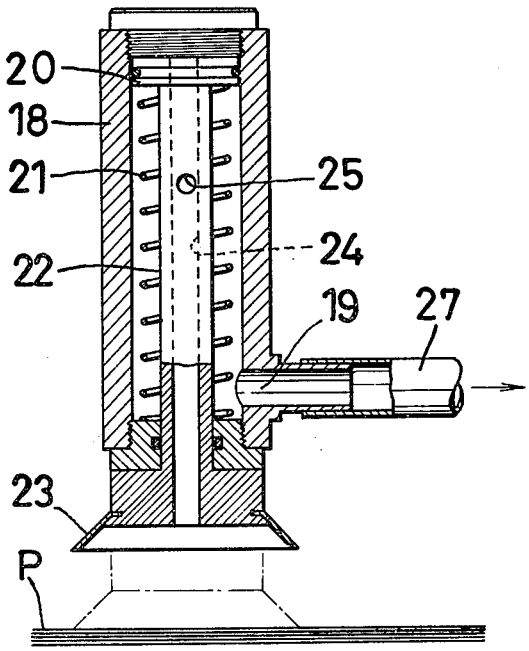
FIG. 7 is a sectional view of the cylinder.

When suction force is applied through the suction hose 26, negative referring to FIG. 7, it will be seen that pressure will prevail in the cylinders 18 and pass to the suction pad 23 through the suction path 24 and the hole 25 so that the topmost paper blank P will be sucked up by the suction pad 23.

When the lower end of the suction pad 23 is open, the suction force acting at the hole 25 is smaller than that acting on the bottom surface of the piston 20 because of smaller effective area. Therefore, the piston 20 will go down against the bias of the spring 21 and the suction pad 23 will go toward the stack of paper blanks P on the paper table 1.

When the suction pad 23 has gone down to the uppermost paper blank P so that its lower end is closed, the upper chamber and the lower chamber in the cylinder 18 defined by the piston 20 will be under an equal pressure since they commumicate with each other through the suction path 24 and the hole 25. Because the piston 20 is urged upward by the spring 21, it will go up together with the suction pad 23 sucking the uppermost paper blank P.

When the suction pad 23 has come up to such a position that it butts the lower end of the cylinder 18 or the piston 20 butts the upper end plate of the cylinder 18, referring back to FIG. 4, the cam 29 begins to push the cam follower 30 and thus the suction head 14 forwardly along the guide bar 13.

As the suction head 14 moves forward, the paper blank P sucked thereby gets nipped between the upper and lower feed rollers 16, 17 and is fed forward by the rotation of the feed rollers 16, 17. Then the cam 29 begins to release the cam follower 30 so that the suction head 14 is pushed back by the spring 31 until the back surface of the suction head 14 butts the support block 12. Now, the rear end of the paper blank P comes off the suction pad 23 so that its lower end will be open. Therefore, it again goes down to catch the paper blank P. This cycle is repeated.

The lower feed roller 17 is formed with a plurality of peripheral grooves 32. A claw 33 with a bend 34 at its upper end is disposed in each groove 32. The bend 34 prevents more than one paper blank P from being fed by the suction pad 23 at a time.

An air blow pipe 35 is provided at each side of the paper table 1 (FIG. 4) to blow air through a slit 36 (FIG. 5) in the pipe 35 toward the side of the paper blank P, thereby ensuring the separation of the paper blanks P into individual ones.

The number of the suction heads 14 may be decided according to the size of the paper blanks P.

Next, how the paper table 1 is raised will be described with reference to FIGS. 8–10.

The upper sprocket 7 is disposed inside of a side frame 40 and has a shaft 41 extending through the side frame 40. To the end of the shaft 41 as shown in FIGS. 9 and 10, there is connected a dog clutch 42 having an input clutch 43 and an output clutch 44. The input clutch 43 is mounted so as to be turnable with respect to the shaft 41 but not movable axially. The output clutch 44 is mounted to be axially slidable but not turnable with respect to the shaft 41. As shown only in FIG. 10, a spring 45 is supported on an end plate 46 of the shaft 41 to urge the output clutch 44 toward the input clutch 43. Their claws 47 engage each other.

A cam lever 48 has a tubular portion 49 mounted on the input clutch 43. Between the tubular portion 49 and the input clutch 43, there is provided a one-way clutch 50 which coupled the cam lever 48 to the input clutch 43 only when the former sways in the direction of an arrow shown in FIG. 8.

Figure 8:
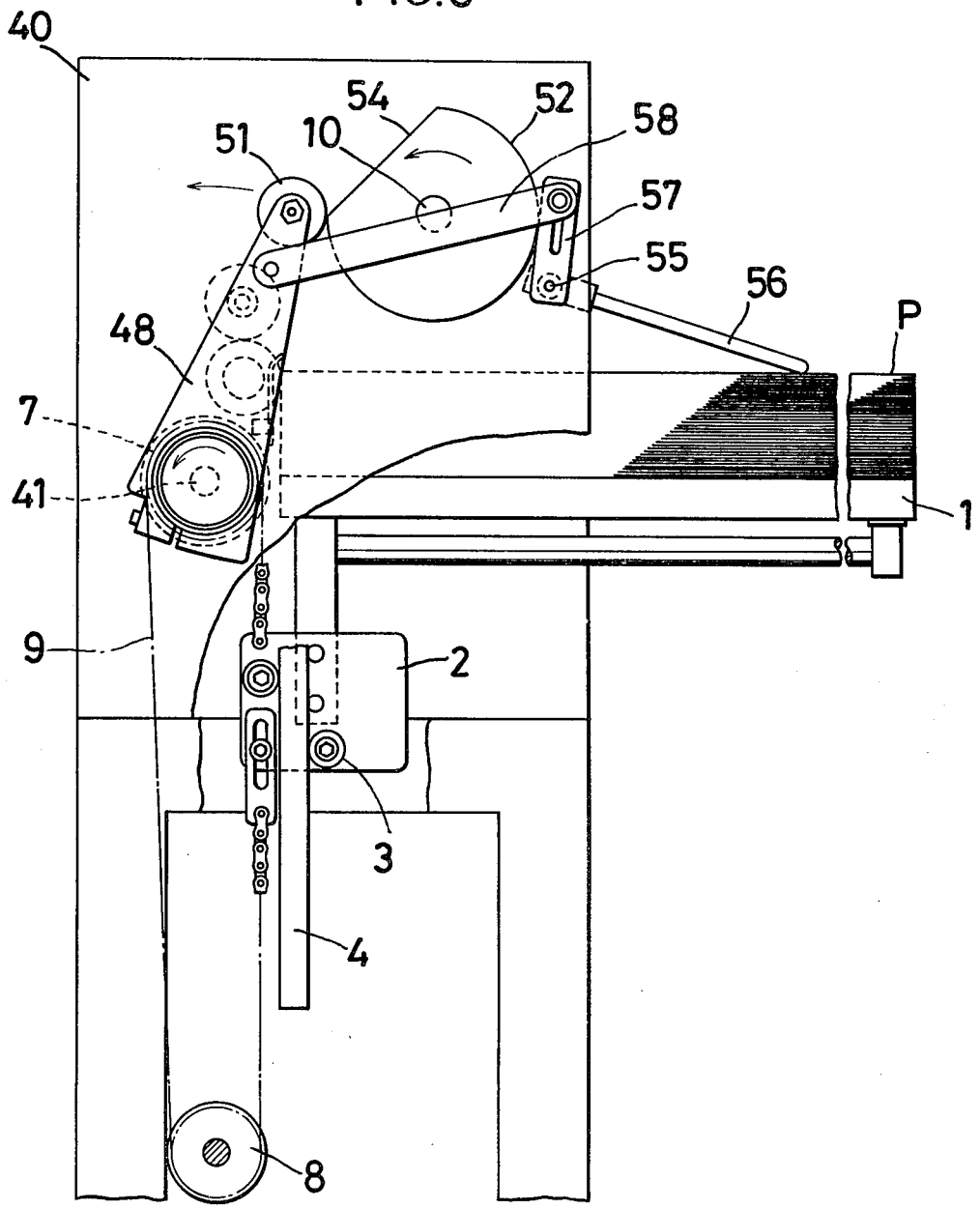
FIG. 8 is a sectional view showing the table elevating mechanism used in the embodiment.
Figure 9:
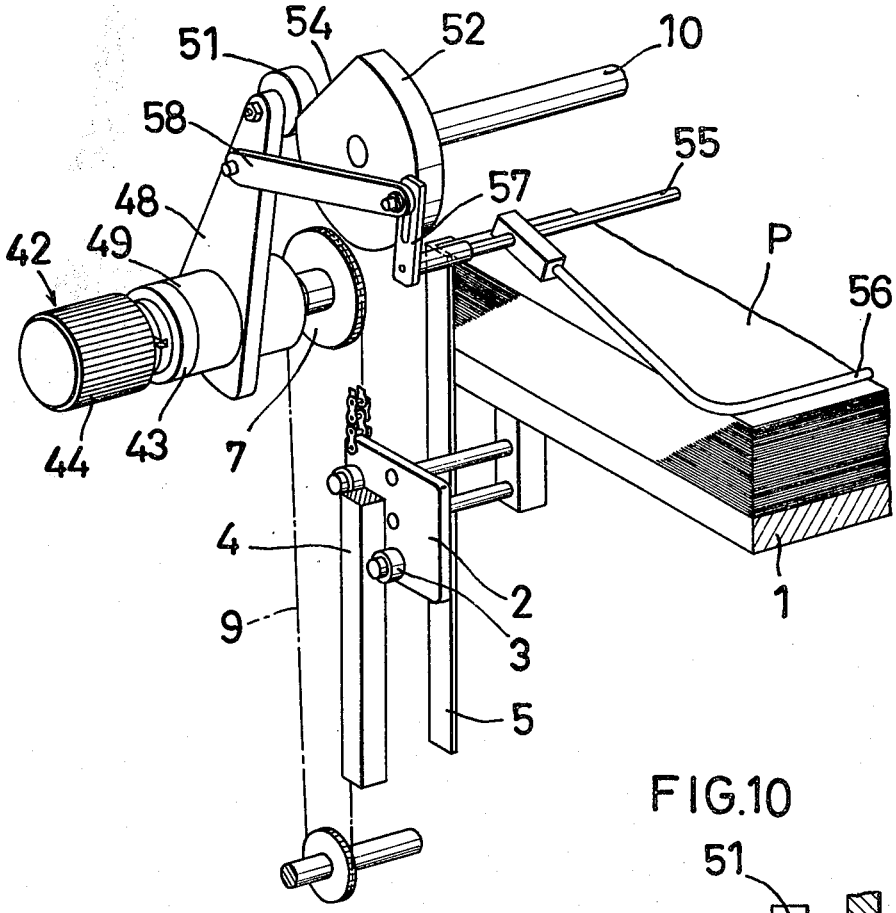
FIG. 9 is a perspective view of the same.

Referring to FIG. 8, a cam follower 51 is rotatably supported at the other end of the cam lever 48. The cam follower 51 is associated with a disc cam 52 fixedly mounted on one end of the driving shaft 10 which is kept turning in one direction. The disc cam 52 has a flat portion 54. When it makes a full turn, the cam lever 48 does one swaying motion around the shaft 41.

A support bar 55 disposed over the paper table 1 has its end rotatably supported by the side frame 40. An L-shaped detection bar 56, best shown in FIG. 9, is rockably connected to the support bar 55 and is inclined downward to its end. A crank arm 57 is attached to one end of the support bar 55. A link 58 couples the crank arm 57 to the cam lever 48. When the cam lever 48 rocks, the support bar 55 turns by a certain angle so that the detection bar 56 rocks up and down.

When several paper blanks P are fed from the paper table 1, some clearance will be formed between the detection bar 56 and the top surface of the stack of the paper blanks P on the paper table 1. In this state, the rotation of the disc cam 52 by the shaft 10 in the direction of the arrow (FIG. 8) causes the cam lever 48 to rock. Only when the cam lever 48 moves to the left in FIG. 8, the one-way clutch 50 (FIG. 10 only) will operate so that the input clutch 43 (FIGS. 9 and 10) will turn. Rotation of the input clutch 43 is transmitted to the output clutch 44 on one end of the shaft 41 and to the upper sprocket 7 on the opposite end of the shaft 41. When the cam lever rocks to the right in FIG. 8, the one-way clutch 50 (FIG. 10 only) will not operate so that the upper sprocket 7 does not turn. In short, with some clearance present between the detection bar 56 and the top of the stack of paper blanks P, the upper sprocket 7 will turn intermittently in the direction of the arrow (FIG. 8) as the cam lever 48 rocks. As shown in FIG. 8, the chain 9 runs around the upper sprocket 7 and the lower sprocket 8 in the direction of the arrow so that the paper table 1 will go up.

On the other hand, the rocking motion of the cam lever 48 is transmitted through the link 58 to the crank arm 57, so that the support bar 55 will turn and thus the detection bar 56 will move up and down.

When the paper table 1 goes up to such a position that the top of the stack of paper blanks P abuts the detection bar 56 (FIG. 8), the latter is prevented from rocking downward. Therefore, the crank arm 57 and the link 58 cannot move any more. In this position, the cam follower 51 is kept away from the flat portion 54 of the disc cam 52 turning continually. Therefore, the upper sprocket 7 will not turn so that the paper table 1 will not go up further.

When the paper blanks P are fed from top of their stack so that its top level lowers and some clearance is formed under the detection bar 56, the paper table 1 will be raised again by the above-mentioned arrangement.

Figure 10:
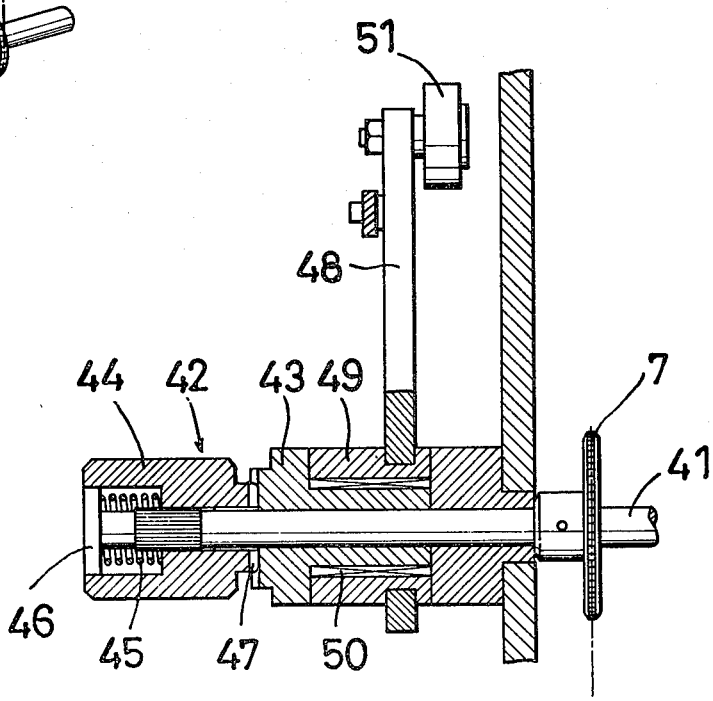
FIG. 10 is a sectional view of the same including clutches.

When all the paper blanks P have been fed or when work is stopped, the driving shaft 10 is stopped and, as shown in FIG. 10, the output clutch 44 is pulled against the bias of the spring 45 out of engagement with the input clutch 43. Now, the shaft 41 of the upper sprocket 7 becomes free and rotates under the weight of the paper table 1. When the output clutch 44 is released, the claws 47 will engage again and the paper table 1 will stop lowering. By repeating the pulling and releasing of the output clutch 44, the paper table 1 can be lowered to a desirable height. After replenishment of the sheets of paper P, the output clutch 44 can be manually turned to turn the upper sprocket 7 to raise the paper table 1.

Although the present application has been described with reference to a preferred embodiment, it is to be understood that various changes and variations can be made within the scope of the present invention.

What is claimed is:

1. A paper feeder for feeding blanks one after another, said paper feeder comprising:

a paper table vertically movable for supporting a stack of blanks, a suction head provided over said paper table to be movable back and forth and having a cylinder, said cylinder having a suction port for connection to a source of suction force and having a piston elevatably mounted and a spring means for urging said piston upwardly, said piston having a rod connected to its lower end, a suction pad means, mounted to a lower end of said rod, for sucking up the blanks one after another, said piston and said rod having a suction path extending axially therethrough and said rod also having a hole means in its wall for communicating said suction path with the inside of said cylinder, a driving shaft provided behind said suction head, a cam means, mounted on said driving shaft, for moving said suction head forwardly, a spring means for urging said suction head backward toward said cam means, and a table drive means for raising said paper table to keep the top level of the stack of blanks at a predetermined height, said table drive means comprising:

a pair of sprockets;

a chain or belt means running around said sprockets and connected to said paper table, a dog clutch provided at one end of a shaft of one of said sprockets, said dog clutch having an input clutch which is not axially movable but rotatable with respect to said shaft, a cam lever connected to said input clutch, a one-way clutch means, provided between said cam lever and said input clutch, for coupling the cam lever and the input clutch together, a cam means, fixedly mounted on said driving shaft, for rocking said cam lever, said dog clutch transmitting the rocking motion of said cam lever to said shaft of one of the sprockets, thereby rotating it and thus raising said paper table, a support bar means for extending transversely over said paper table so as to be rotatable, a detection bar means, rockably connected to said support bar, for limiting the raising of said paper table, and a crank arm and a link means for coupling said support bar means to said cam lever.

2. A paper feeder having a table drive means for raising a paper table to keep the top level of the stack of blanks at a predetermined height, said table drive means comprising:

a pair of sprockets, a chain or belt means running around said sprockets and being connected to said paper table, a dog clutch provided at one end of a shaft of one of said sprockets, said dog clutch having an input clutch which is not axially movable but rotatable with respect to said shaft, a cam lever connected to said input clutch, a one-way clutch means, provided between said cam lever and said input clutch, for coupling the cam lever and the input clutch together, a cam means, fixedly mounted on a driving shaft, for rocking said cam lever, said dog clutch transmitting the rocking motion of said cam lever to said shaft of one of the sprockets, thereby rotating it and thus raising said paper table, a support bar means for extending transversely over said paper table so as to be rotatable, a detection bar means, rockably connected to said support bar means, for limiting the raising of said paper table, and a crank arm and a link means for coupling said support bar means to said cam lever.

* * * * *